US005657505A

United States Patent [19]

Gallagher et al.

[11] Patent Number: 5,657,505

[45] Date of Patent: Aug. 19, 1997

[54] DRAIN CLEANING APPARATUS

[75] Inventors: Michael P. Gallagher, Brunswick, Ohio; Jay R. Thisdell, Stanardsville, Va.

[73] Assignee: Emerson Electric Company, St. Louis, Mo.

[21] Appl. No.: 593,737

[22] Filed: Jan. 29, 1996

[51] Int. Cl.[6] ..... B08B 9/02

[52] U.S. Cl. ..... 15/104.33

[58] Field of Search ..... 15/104.31, 104.33

[56] References Cited

U.S. PATENT DOCUMENTS

| | | | |
|---|---|---|---|
| 2,201,733 | 2/1940 | Kollmann . | |
| 2,247,004 | 3/1941 | Sullivan . | |
| 2,705,642 | 12/1955 | Chasar . | |
| 2,940,099 | 6/1960 | Kollmann | 15/104.33 |
| 3,075,218 | 1/1963 | Kollmann | 15/104.33 |
| 4,361,924 | 12/1982 | Irwin | 15/104.33 |
| 4,364,139 | 12/1982 | Babb . | |
| 4,447,926 | 5/1984 | Rothenberger . | |

FOREIGN PATENT DOCUMENTS

| | | |
|---|---|---|
| 1942341 | 4/1971 | Germany . |

*Primary Examiner*—David Scherbel
*Assistant Examiner*—Terrence Till
*Attorney, Agent, or Firm*—Vickers, Daniels & Young

[57] ABSTRACT

Drain Cleaning Apparatus for rotating a drain cleaning snake comprises a frame and housing assembly supporting an axially displaceable clutch actuating shaft which supports a first clutch actuator for rotation relative thereto and axial displacement therewith. A second clutch actuator is coaxial with the first actuator and supported in the housing for rotation relative thereto. A radially expandable and contractible clutch is captured between the two clutch actuators for engaging and disengaging a drain cleaning snake extending therethrough. A motor drives the first clutch actuator through a transmission pulley and belt arrangement in which the belt is axially slidable relative to a pulley in response to axial displacement of the first clutch actuator relative to the second clutch actuator. The clutch and second clutch actuator are in a shroud at one end of the housing, and the axial position of the second actuator relative to the first actuator is adjustable. The shroud is mounted on the flame to facilitate removal and replacement of the clutch and access to the second clutch actuator, and a housing portion adjacent the shroud is removable to provide access to the transmission components.

67 Claims, 7 Drawing Sheets

DRAIN CLEANING APPARATUS

BACKGROUND OF THE INVENTION

This invention relates to the art of drain cleaning apparatus and, more particularly, to improvements in portable drain cleaning apparatus of the character wherein a drain cleaning snake is manually advanced through the apparatus into a drain or sewer line and is then rotated for the drain cleaning snake to clear an obstruction encountered in the line.

Portable drain cleaning machines or apparatus of the character to which the present invention is directed are well known and, generally, comprise a housing structure supporting a coaxial arrangement of shaft components through which a drain cleaning snake is manually fed and which includes a clutching arrangement for intermittently engaging and rotating the snake in conjunction with a drain cleaning operation. The clutching arrangement includes radially expandable and contractible clutch elements located axially between and coaxial with clutch actuating components of the apparatus and which clutch actuating components are relatively axially displaceable toward and away from one another to respectively achieve contracting and expanding displacement of the clutch elements relative to the snake. Most often, one of the clutch actuating components is axially fixed and the other is axially displaceable toward and away therefrom by means of a manually operable lever arrangement. The clutch actuating components are rotatable and the clutch is axially captured therebetween for rotation therewith, and the clutch actuating components and clutch are rotated by a drive motor and a drive coupling arrangement between the motor and one of the clutch actuating components. Such drain cleaning apparatus is portable and, generally, is provided with a handle by which the apparatus can be carried by an operator from one location to another. In use, a drain cleaning snake is manually inserted through the apparatus and into a drain to be cleaned. If the drive motor is operating, the clutch and clutch actuating components rotate relative to the snake, whereby the latter can be manually advanced through the apparatus and into the drain until an obstruction is encountered. The operating lever is then displaced relative to the housing for the clutch to engage and rotate the snake and, in connection with dislodging or clearing the obstruction, the lever can be released to disengage the clutch from the snake, whereupon the operator can manually feed the snake further into the drain and then displace the operating lever to again cause rotation of the snake relative to the apparatus.

While drain cleaning apparatus of the foregoing character heretofore available serves its intended purpose with respect to performing drain cleaning operations, there are a number of disadvantages attendant to the construction and operation of the apparatus. In this respect, for example, the clutch operating arrangements are structurally complex, and the structural interrelationships between the latter and the drive transmission as well as the housing by which the latter are supported render maintenance and/or replacement operations both time consuming and complex and, thus, undesirably expensive. More particularly in this respect, access to the clutch and clutch actuating components as well as the transmission components most often requires a time consuming disassembly of the housing, and then a further time consuming manipulation and/or disassembly of the components parts in the housing to achieve the release of the clutch unit, clutch actuating components and/or transmission components. Following a removal of one or more of the latter parts for maintenance and/or replacement, a time consuming reassembly is required to place the apparatus back into condition for use.

A further disadvantage resides in the fact that such drain cleaning machines heretofore available require either a replacement of the clutch unit for the apparatus to accommodate snakes having different diameters, or the use of a structurally complex collet insert arrangement for the latter purpose such as shown for example in U.S. Pat. No. 4,447,926 to Rothenberger. As mentioned above, removal and replacement of the clutch unit is a difficult and time consuming operation, and a requirement of a collet insert adds to the structural complexity of a machine as well as requiring an additional part or parts for use therewith as well as the time required for an operator to assemble and/or disassemble an insert relative to the machine.

Another disadvantage relates to the manner in which the apparatus is supported and the manner in which the component parts of the apparatus are supported internally of the apparatus. In this respect, the component parts are both enclosed in and supported by a housing which also serves to support the apparatus on an underlying support surface during use. Thus, the entire housing must have structural integrity, whereby both the cost and weight thereof are undesirably high. Furthermore, the internal structure of the housing required to support and accommodate the component parts of the apparatus is complex which adds further to the cost thereof and to the complexity and cost of performing maintenance and/or replacement operations.

SUMMARY OF THE INVENTION

Portable drain cleaning apparatus in accordance with the present invention advantageously minimizes or overcomes the foregoing and other disadvantages of such apparatus heretofore available. In accordance with one aspect of the invention, a unique transmission arrangement enables a more efficient location of the clutch and clutch actuating components and thus access thereto as well as to the transmission components for maintenance and/or replacement purposes. More particularly in this respect, the transmission arrangement provides for driving the clutch and clutch actuating components through the one of the clutch actuating components which is axially displaceable toward the other to achieve contraction of the clutch relative to a drain cleaning snake to be rotated thereby. In accordance with another aspect of the invention, a clutch adjusting arrangement advantageously provides for adjusting the clutch unit in the apparatus to accommodate a range of different diameter snakes without having to access the interior of the apparatus and without having to employ a special clutch insert for the latter purpose. More particularly in this respect, the clutch actuating component relative to which the axially displaceable clutch actuating component moves to achieve expanding and contracting of the clutch unit is axially adjustably supported relative to the apparatus so as to enable incremental adjustment of the axial position thereof relative to the axially displaceable clutch actuating component. Thus, the inner diameter of the expandable and contractible clutch unit can be adjusted in accordance with a given diameter snake with which the apparatus is to be used.

In accordance with yet another aspect of the invention, an end portion of the apparatus housing supports the one of the clutch actuating components relative to which the other is axially displaceable to achieve expansion and contraction of the clutch unit, and the latter housing portion is releasably coupled to the remainder of the housing so as to be readily separable therefrom. The clutch unit is axially captured between the clutch actuating components, and such separability of the end portion of the housing readily provides access to the one clutch actuating component and the clutch unit for maintenance and/or replacement thereof more efficiently and quickly then heretofore possible. Moreover, such separability enables the clutch unit to be readily changed to another clutch unit which will accommodate a different range of snake diameters than that accommodated by the removed clutch unit, thus adding to the versatility of the apparatus while reducing the structural complexity thereof.

In accordance with still another aspect of the invention, the component parts of the transmission assembly and the displaceable clutch actuating component are structured and structurally interrelated with one another and with the clutch and the other clutch actuator so as to be located adjacent the removable end portion of the housing. The transmission and displacable clutch actuating components are readily accessible by removing a second end portion of the housing immediately adjacent the removable end portion. Thus, the component parts of the drain cleaning apparatus which need to be accessed most often for maintenance and/or replacement purposes are more readily and quickly accessible than heretofore possible. In accordance with yet a further aspect of the invention, the major component parts of the apparatus including the drive motor are supported by a main housing member which in turn is supported in suspension by a frame assembly which supports the apparatus relative to an underlying surface. This advantageously enables the use of plastic material for a housing portion which encloses the drive motor and the housing member which encloses the component parts of the transmission and the displacable clutch actuating member. Accordingly, the weight of the apparatus is advantageously reduced as is the cost of manufacturing while adding to the structural simplicity and serviceability thereof.

It is accordingly an outstanding object of the present invention to provide improvements in connection with the construction and operation of portable drain cleaning apparatus of the character operable to achieve rotation of a drain cleaning snake which is manually advanced therethrough relative to a drain to be cleaned.

Another object is the provision of apparatus of the foregoing character having improved accessibility to component parts thereof for purposes of maintenance and/or replacement operations.

Still another object is the provision of apparatus of the foregoing character in which the clutch and clutch actuating components by which the snake is rotated are readily accessible to facilitate maintenance and/or replacement thereof including replacement of a given clutch unit for another which will enable the apparatus to accommodate snakes having different diameters from that accommodated by the replaced clutch unit.

Still a further object is the provision of drain cleaning apparatus of the foregoing character wherein the expanded disposition of a clutch unit in the apparatus is adjustable without any disassembly of the apparatus thus to enable the apparatus to accommodate snakes having different diameters.

Yet a further object is the provision of drain cleaning apparatus of the foregoing character having a unique transmission arrangement which enables driving of the clutch and clutch actuating components through the one clutch actuating component which is axially displaced toward and away from the other to achieve expansion and contraction of the clutch unit.

Another object is the provision of drain cleaning apparatus of the foregoing character wherein the clutch unit, the clutch actuating components and the component parts of the transmission are located at one end of the apparatus housing, thus to facilitate access thereto for maintenance and/or replacement purposes.

A further object is the provision of drain cleaning apparatus of the foregoing character wherein the major component parts are supported in a main housing member which is supported by a frame assembly, thus enabling a more economical and lighter weight construction of the apparatus than heretofore possible.

Still another object is the provision of drain cleaning apparatus of the foregoing character wherein serviceability is more readily, economically and efficiently achieved than with such apparatus heretofore available.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Figure 1:
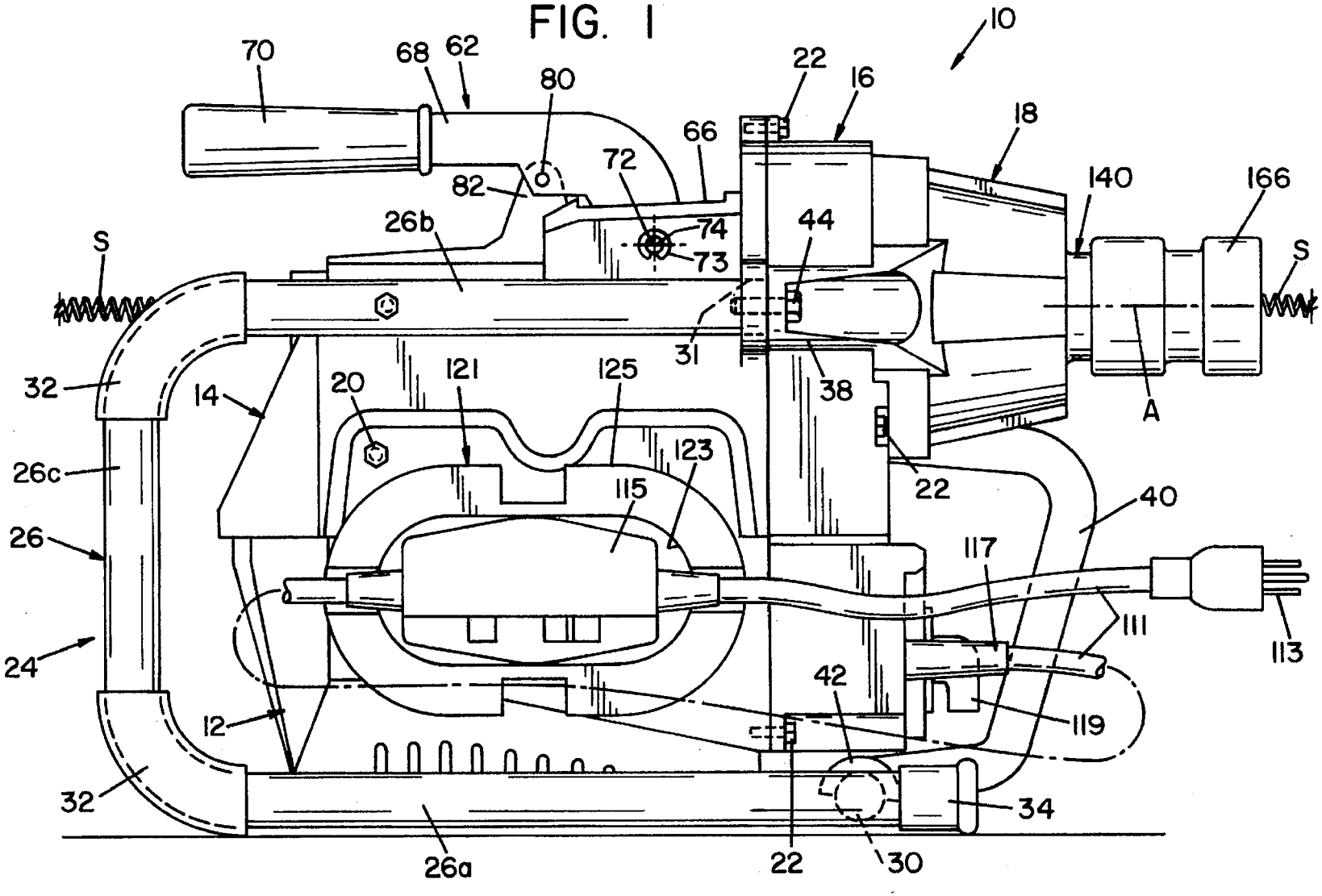
FIG. 1 is a side elevation view of drain cleaning apparatus according to the invention.
Figure 2:
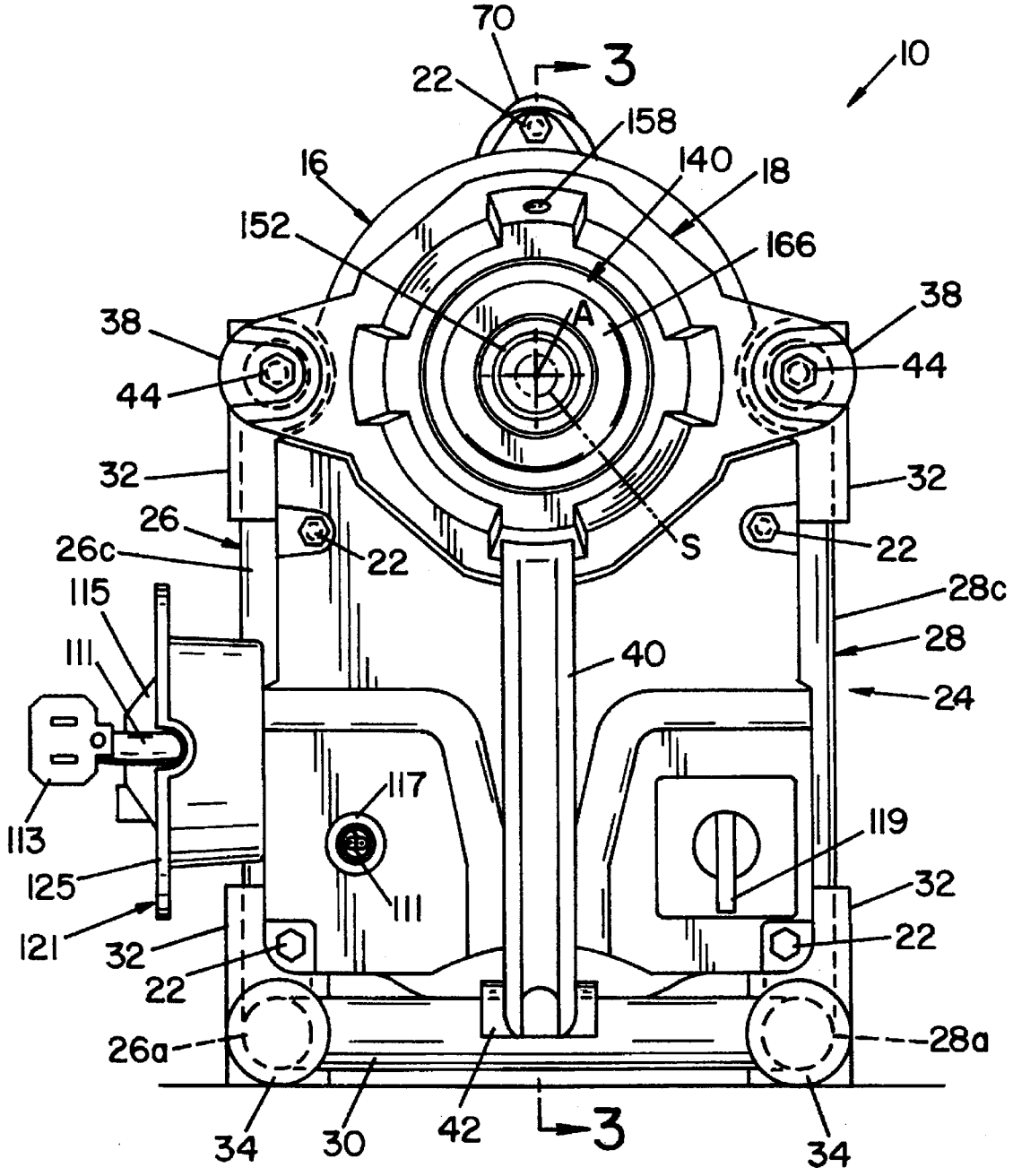
FIG. 2 is a rear end elevation view of the apparatus looking in the direction from right to left in FIG. 1.

Referring now in greater detail to the drawings wherein the showings are for the purpose of illustrating a preferred embodiment of the invention only and not for the purpose of limiting the invention, drain cleaning apparatus 10 in accordance with present invention includes a housing assembly comprising lower and upper front housing members 12 and 14, respectively, a transmission covering housing member 16 adjacent the rear ends of front housing members 12 and 14, and a shroud housing member 18 adjacent the rear end of housing member 16. Upper front housing member 14 and shroud 18 are of cast aluminum, and housing members 12 and 16 are of a suitable plastic material and, preferably, an ABS plastic. Front housing members 12 and 14 are interconnected by a plurality of threaded fasteners 20 and housing member 16 is interconnected with front housing members 12 and 14 by a plurality of threaded fasteners 22. As will become apparent hereinafter, the housing assembly has an axis A, and the apparatus further includes a frame assembly 24 of steel tubing comprising laterally spaced apart U-shaped tubular side members 26 and 28 having corresponding lower legs 26*a* and 28*a*, corresponding upper legs 26*b* and 28*b*, and corresponding front legs 26*c* and 28*c* between the lower and upper legs. The rear ends of lower legs 26*a* and 28*a* are rigidly interconnected by a tubular cross member 30 which is spaced from and transverse to axis A, and the rear ends of upper legs 26*b* and 28*b* extend into openings 31 in housing member 14. The corners between front legs 26*c* and 28*c* and the corresponding lower and upper legs of the frame members are preferably provided with bumpers 32 of a suitable material such as black rubber, and the rear ends of lower legs 26*a* and 28*a* are provided with bumpers or cap members 34 of similar material. The rear ends of upper legs 26*b* and 28*b* receive plugs 36 which are welded or otherwise secured therein and which serve to releaseably attach shroud 18 relative to housing members 12, 14 and 16. More particularly in this respect, shroud 18, which will be described in greater detail hereinafter, includes a pair of forwardly extending arms 38 on laterally opposite sides of axis A, and a depending support arm 40 having a generally U-shaped contour and a downwardly open arcuate lower end portion 42 which rests on and is pivotally supported by cross member 30 of frame assembly 24. Plugs 36 include threaded apertures 36*a* which receive threaded fasteners 44 by which arms 38 are releaseably interconnected with the plugs and thus upper frame legs 26*b* and 28*b*. When fasteners 44 are removed, shroud 18 is pivotal axially outwardly from housing member 16 about the axis of frame member 30 for the purpose set forth hereinafter.

Figure 3:
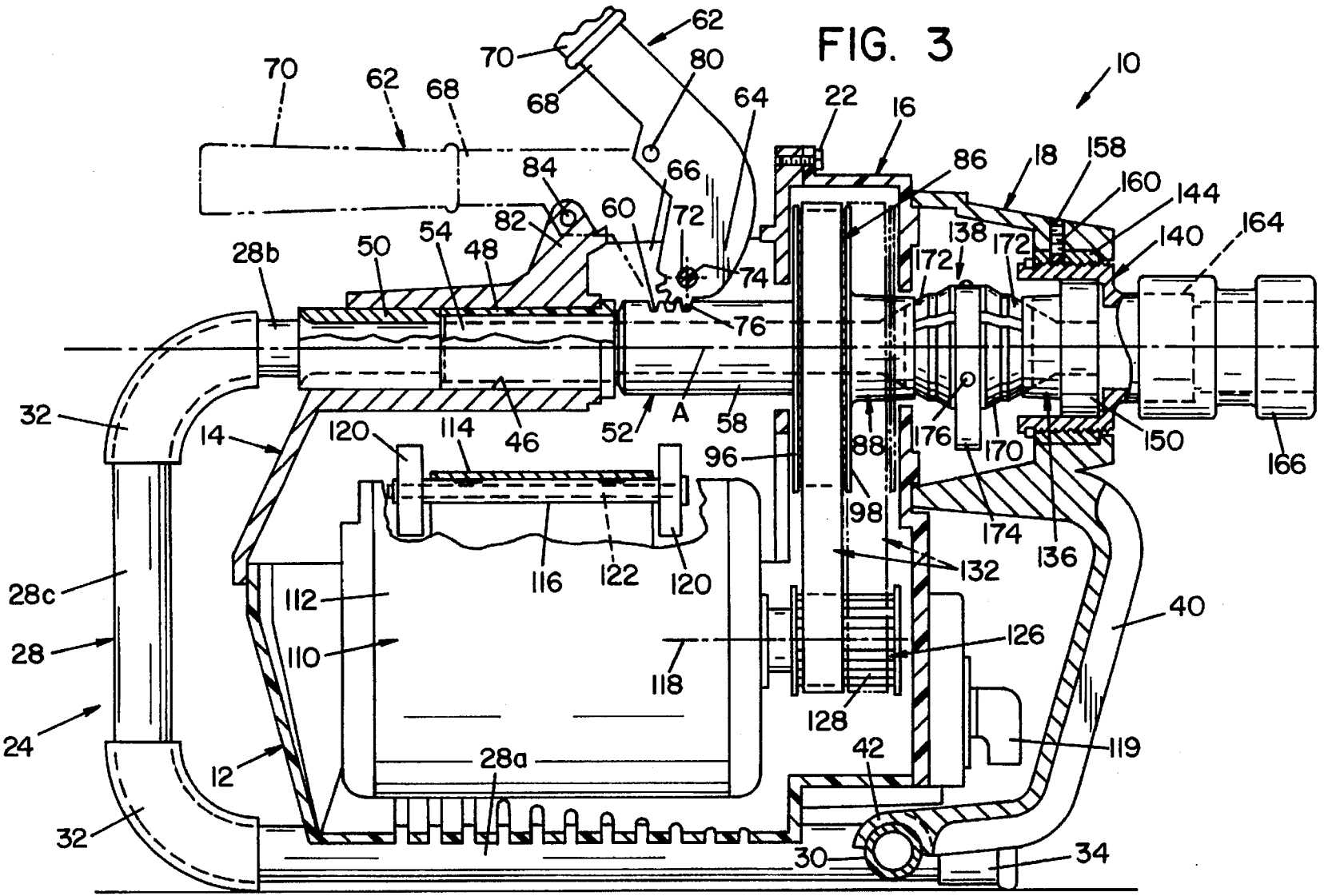
FIG. 3 is a cross-sectional elevation view of the apparatus taken along line 3—3 in FIG. 2.
Figure 4A:
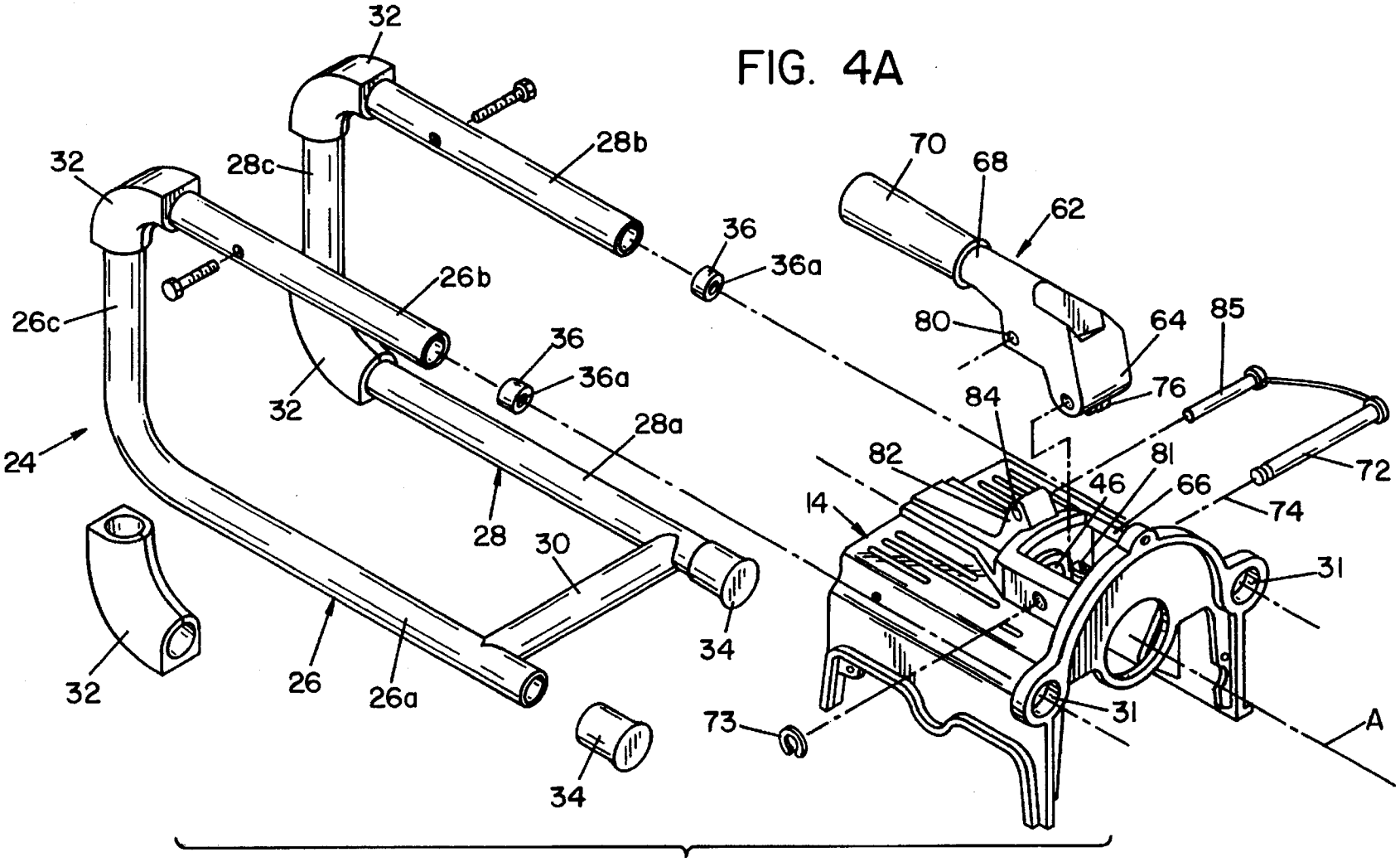
FIGS. 4A, 4B and 4C together provide an exploded perspective view of the component parts of the drain cleaning apparatus.
Figure 4B:
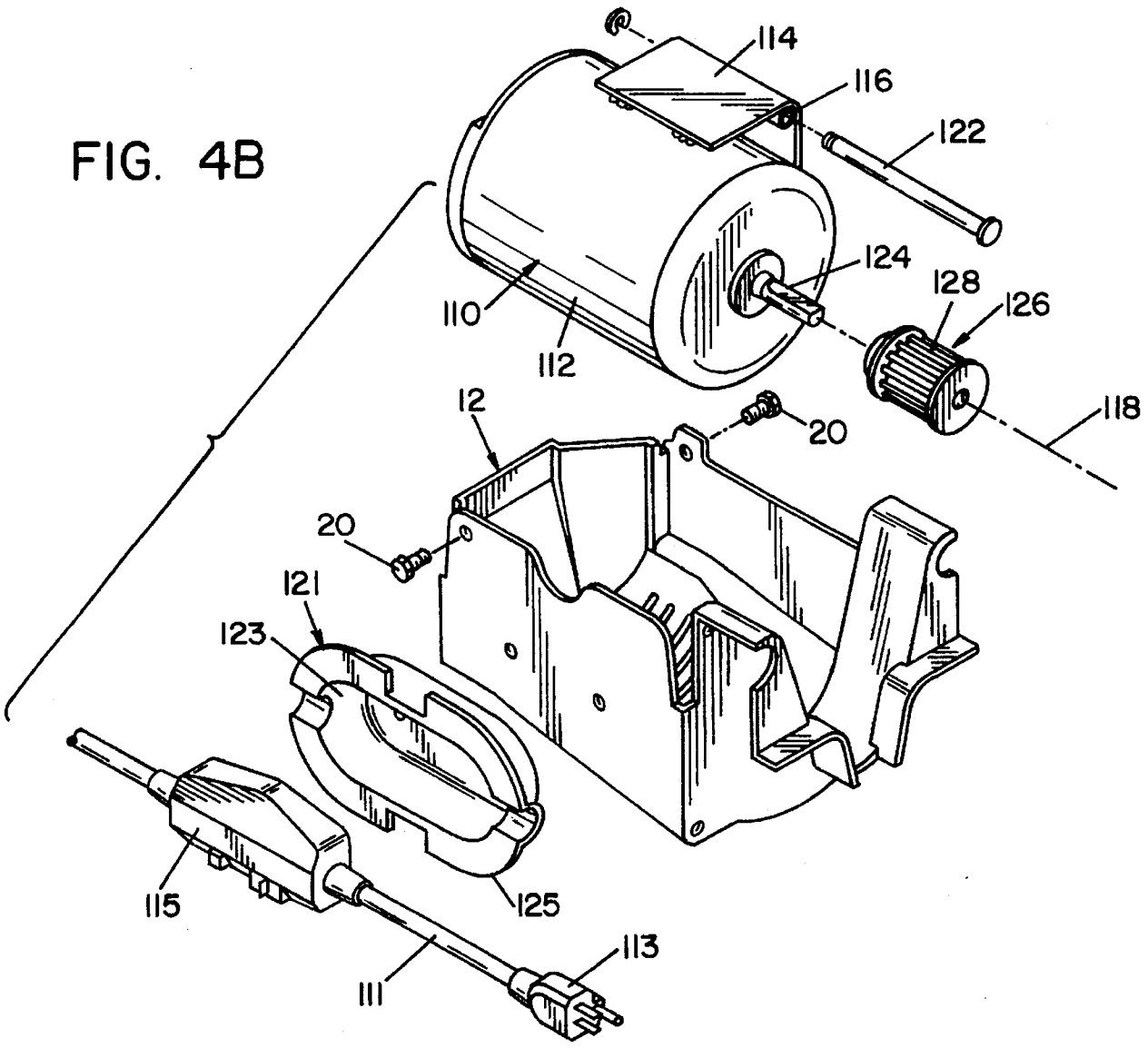

As best seen in FIGS. 3 and 4 A–C, upper front housing member 14 includes a bore 46 coaxial with axis A and receiving a tubular bearing sleeve 48 which is preferably of a nylon material. A steel insert 50 is received in bore 46 behind sleeve bearing 48 for the purpose set forth hereinafter. A tubular shaft 52 has a front end 54, a rear end 56 and an intermediate portion 58 provided with teeth 60 adjacent front end 54. End 54 of shaft 52 is received in sleeve bearing 48 and is supported therein for reciprocating displacement toward and away from the rear end of the housing assembly. An operating lever 62 has an inner end 64 extending through an opening 66 therefor in the top of housing member 14 and has a forwardly extending outer end 68 provided with a handle grip 70 by which the lever is manipulated as set forth more fully hereinafter. Inner end 64 of the lever is interconnected with housing member 14 by means of a headed pin 72 which is held in place on housing member 14 by a spring clip 73. Pin 72 supports the lever for pivotal displacement in opposite directions about a lever axis 74 spaced above and transverse to axis A. Inner end 64 of lever 62 is provided with a plurality of teeth 76 intermediate the sides thereof, and teeth 76 interengage with teeth 60 on tubular shaft 52 whereby, as set forth more fully hereinafter, pivotal displacement of lever 62 in opposite directions about axis 74 axially displaces tubular shaft 52 toward and away from the rear of the housing assembly. A tension spring 78 has one end 78*a* staked to portion 58 of shaft 52 such as by fastener 79 and the other end 78*b* engaged in an apertured ear 81 below opening 66 in housing member 14. Spring 78 biases shaft 52 toward the front of the housing assembly, and shaft 52 in turn biases operating lever 62 clockwise about pin 72 in FIG. 3 to the solid line position of the lever shown in the latter figure. Lever 62 has a storage position shown by broken lines in FIG. 3 in which the lever is adjacent the housing assembly and generally parallel to axis A. In the embodiment illustrated, inner end 64 of the lever includes an opening 80 and housing member 14 includes an upwardly extending boss 82 having an opening 84 adapted to be aligned with opening 80 when lever 62 is in its storage position. Aligned openings 80 and 84 are adapted to receive a removable lock pin 85 which preferably is tethered to pin 72. Lever 62 is releaseably held in the storage position by pin 85 and, in the latter position, the lever provides a handle by which the apparatus can be transported from one location to another.

Figure 5:
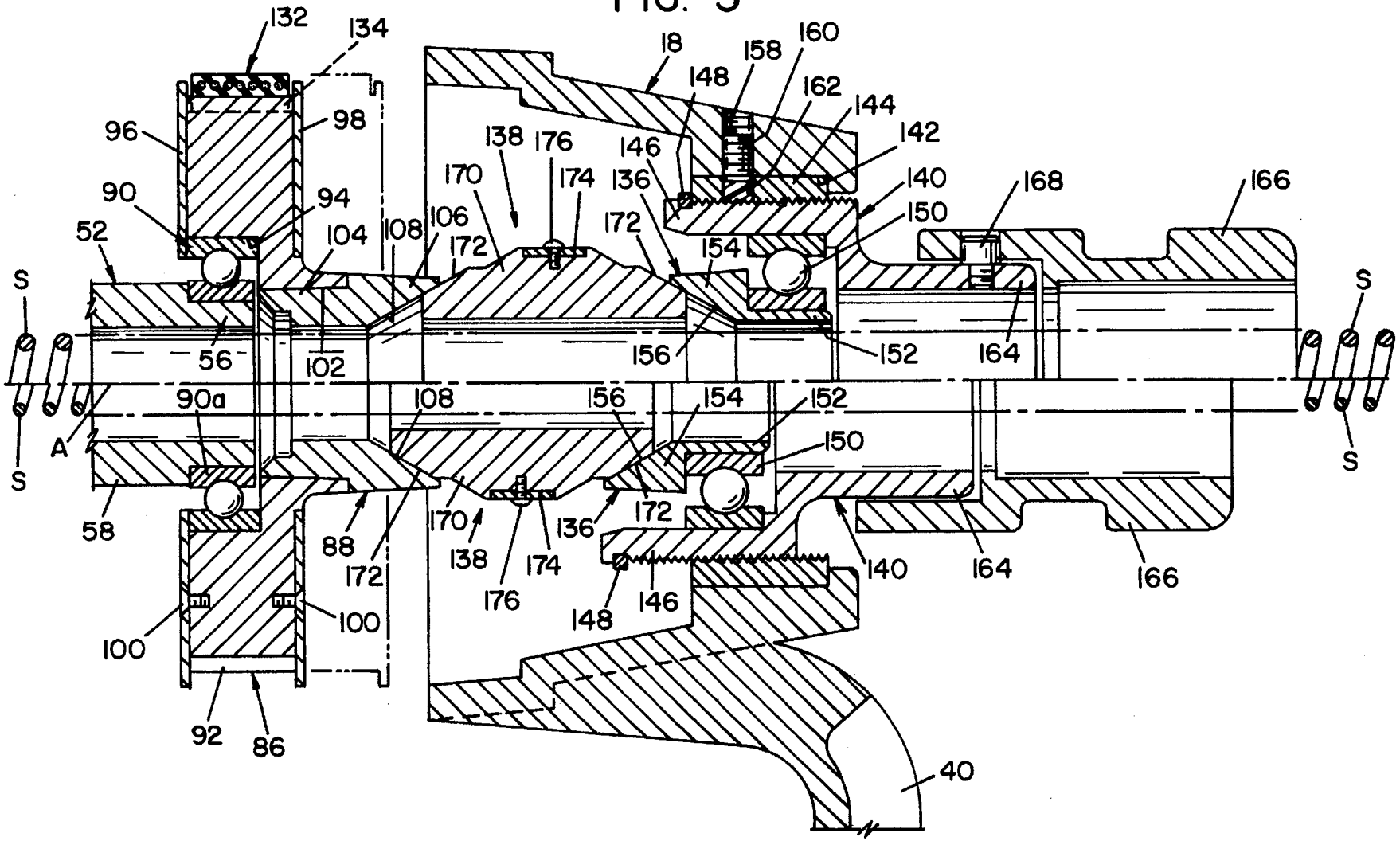
FIG. 5 is an enlarged sectional elevation view of the clutch and clutch actuating components of the apparatus.

Rear end 56 of tubular shaft 52 extends from front housing member 14 into transmission covering housing member 16 and supports transmission and clutch actuating components of the apparatus. More particularly in this respect, as best seen in FIGS. 3 and 5 of the drawing, a transmission pulley 86 of cast aluminum and a first clutch actuating member 88 are supported on rear end 56 of tubular shaft 52 by a bearing assembly 90 for rotation relative to shaft 52 about axis A and for axial displacement with the tubular shaft. The outer periphery of transmission pulley 86 is provided with teeth 92 for the purpose set forth hereinafter, and the axially inner end of the transmission pulley is provided with a circumferential pocket 94 which receives bearing unit 90. An annular plate 96 is attached to one of the axially opposite sides of pulley 86 by fasteners 100 and the other side includes an integral flange 98, both of which extend radially outwardly a short distance beyond teeth 92 for the purpose set forth hereinafter. Plate 96 axially retains bearing unit 90 in pocket 94, and inner race 90*a* of the bearing unit interengages with rear end 56 of shaft 52 by a slip fit. Transmission pulley 86 has a bore 102 therethrough coaxial with axis A and, in the embodiment illustrated, first clutch actuating member 88 is a steel insert having an inner end 104 axially received in bore 102 and interengaged therewith such as by knurling inner end 104 of the insert. The outer end 106 of clutch actuating member 88 is provided with a conical surface 108 which diverges axially rearwardly relative to axis A for the purpose set forth hereinafter.

An electric drive motor 110 for the apparatus is pivotally supported in suspension from upper front frame member 14 and depends into lower front housing member 12 which, basically, provides a non-supporting shroud enclosing the motor. Motor 110 includes a casing 112 to which is welded an inverted L-shaped mounting bracket 114 to which is secured a mounting pin tube 116 which is laterally spaced from and parallel to drive motor axis 118. The interior of housing member 14 is provided on one side thereof with a pair of axially spaced apart vertically extending ribs 120 between which mounting plate 114 is positioned, and ribs 120 are provided with openings, not designated numerically, which are adapted to be aligned with pin tube 116 to receive a pivot pin 122 by which the motor is supported in suspension along a pivot axis laterally spaced from and parallel to axis A as well as motor axis 118. Accordingly, it will be appreciated that the weight of motor 110 biases the latter to pivot downwardly relative to housing member 14 about the axis of pin 122. Motor 110 has an output shaft 124 on which a motor transmission pulley 126 is mounted by a set screw, not shown, for rotation therewith. The outer periphery of transmission pulley 126 is provided with teeth 128. For the purpose set forth hereinafter, pulley 126 has an axial length greater than that of transmission pulley 86 by an amount corresponding at least to the maximumaxial displacement of tubular shaft 52 and thus transmission pulley 86, toward the rear end of the housing assembly in response to pivotal displacement of lever 62 from the solid line to the broken line position thereof shown in FIG. 3. An endless transmission belt 132 is trained about transmission pulleys 86 and 126, and the interior of the belt is provided with teeth 134 which drivenly interengage with the teeth of the transmission pulleys. As will be appreciated from the foregoing description of the mounting of motor 110, the weight of the latter in being supported in suspension applies tension to belt 132.

Electric motor 110 is adapted to be connected to a suitable source of electricity by a power cord 111 having a plug 113 at its outer end and a GFI 115 adjacent the latter end. The inner end of cord 111 extends into the housing assembly through a strain relief component 117 mounted on housing member 16 and is connected to the motor through an operating switch, not shown, which is mounted inside housing member 16 and controlled by a switch actuator knob 119 outside housing member 16. Motor 110 is reversible, whereby it will be appreciated that the switch and the wiring from the switch to the motor, not shown, provides for forward and reverse operation of the motor. Lower front housing member 12 is provided with a cord wrap and GFI storage receptacle 121 which includes a pocket 123 and a flange 125 extending peripherally thereabout. During periods of non use of the apparatus, the length of power cord 111 between GFI 115 and strain relief 117 is wrapped about receptacle 121 behind flange 125, and GFI 115 is received in and frictionally interengages with pocket 123 to hold the cord and GFI in the storage position thereof.

In connection with the operation of the apparatus as thus far described, electric motor 110 is operable to rotate motor transmission pulley 126 which in turn rotates transmission pulley 86 and the first clutch actuating member 88. Such rotation of transmission pulley 86 and clutch actuating member 88 is relative to tubular shaft 52 and, during such rotation, shaft 52 and thus transmission pulley 86 and first clutch actuating member 88 are adapted to be displaced axially to the right in FIG. 3 against the bias of spring 78 from the solid line positions thereof to the broken line positions in response to counterclockwise pivotal displacement of lever 62 about lever axis 64. In response to such axial displacement of shaft 52, pulley 86 and clutch actuating member 88, drive belt 132 moves axially with transmission pulley 86 and slides axially forwardly relative to motor transmission pulley 126. When lever 62 is released to return to the solid line position thereof shown in FIG. 3, shaft 58 is displaced axially forwardly by spring 78 back to its initial position shown by solid lines in FIG. 3, whereby transmission pulley 86, clutch actuating member 88 and belt 132 move forwardly therewith and the belt slides axially along motor transmission pulley 126 back to its initial position. Flange plate 96 and flange 98 on transmission pulley 86 axially capture belt 132 therebetween, thus to preclude any axial sliding therebetween during such displacement of the clutch actuating and transmission parts.

As best seen in FIGS. 3 and 5, drain cleaning apparatus 10 further includes a second annular clutch actuating member 136 of steel supported in shroud 18 coaxial with axis A, and a radially expandable and contractible collet or clutch unit 138 which is coaxial with axis A and axially captured between clutch actuating numbers 88 and 136. Clutch actuating member 136 is axially fixed relative to clutch member 88 during operation of the apparatus and, preferably, is mounted in shroud 18 for the axial position thereof relative to clutch actuating member 88 to be incrementally adjustable for the purpose set forth hereinafter. In the embodiment illustrated, such adjustment is achieved by supporting clutch actuating member 136 on a sleeve 140 for rotation relative thereto and threadedly interengaging the sleeve and shroud 18, whereby rotation of the sleeve in opposite directions relative to the shroud axially displaces the sleeve and thus clutch actuating member 136 toward and away from clutch actuating member 88. More particularly in this respect, the axially outer end of shroud 18 is provided with a radially stepped circumferential recess 142 which receives an annular, internally threaded sleeve 144. The axially inner end 146 of sleeve 140 is externally threaded to cooperatively interengage with the internal threads on sleeve 144 and is provided with a stop ring 148 adapted to engage sleeve 144 to limit axially outer displacement of sleeve 140 relative to shroud 18. A bearing unit 150 is radially interposed between axially inner end 146 of sleeve 140 and axially outer end 152 of clutch actuating member 136. The outer and inner races of bearing unit 150 are respectively in slip fit interengagement with the radially inner surface of sleeve portion 146 and the radially outer surface of end 152 of clutch actuating member 136. The axially inner end 154 of clutch actuating member 136 has a conical surface 156 which converges toward axis A in the direction axially outwardly from the axially inner end of the clutch actuating member.

As will be appreciated from the forgoing description and FIG. 5, the threaded interengagement between sleeve 140 and shroud 18 provides for clutch actuating member 136 to be axially adjustable between a maximum spacing relative to clutch actuating member 88 as shown in the upper portion of FIG. 5 and a minimum axial spacing as shown in the lower portion of FIG. 5. Shroud 18 and sleeve 144 are provided with at least one radially extending bore 158 which is internally threaded to receive a set screw or the like 160, and a protective insert 162 of nylon or the like is interposed between the inner end of set screw 160 and the external threads on inner end 146 of sleeve 140. Insert 162 is adapted to be pressed against the latter threads by the set screw to releasably hold sleeve 140 and thus clutch actuating member 136 in an adjusted position relative to clutch actuating member 88. Sleeve 140 has an axially outer end 164 extending from shroud 18 and, preferably, end 164 is provided with an externally knurled tubular operating knob 166 secured to sleeve end 164 by a radially extending threaded fastener 168 to facilitate rotation of sleeve 140 by an operator of the apparatus.

Figure 4C:
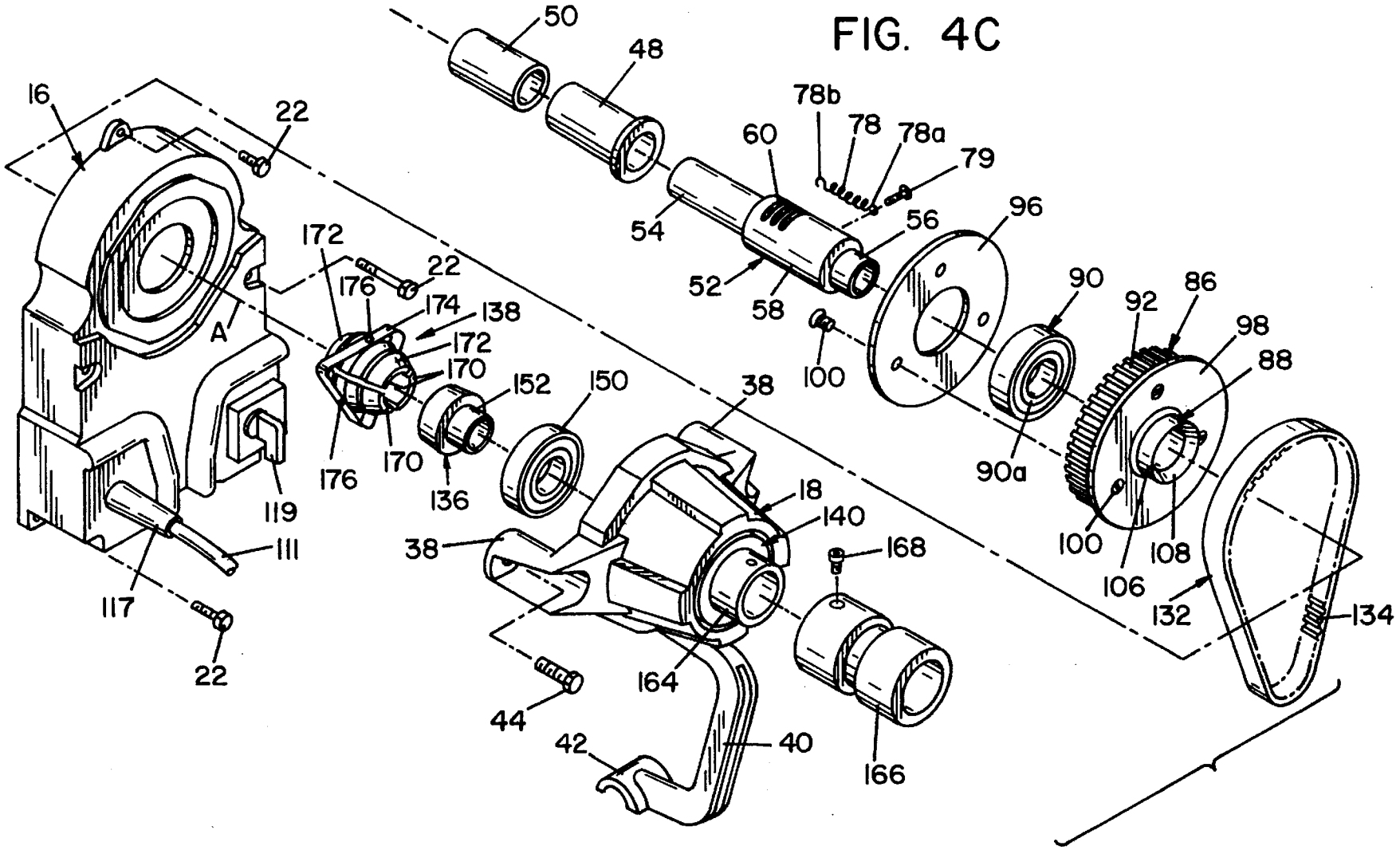

When the component parts of the housing assembly are in the assembled relationship shown in FIG. 3, collet or clutch unit 138 is axially captured between clutch actuating members 88 and 136 for displacement between an initial expanded position and a contracted position relative to axis A during operation of the apparatus. In the embodiment illustrated, as best seen in FIG. 4C, clutch unit 138 is comprised of three circumferentially adjacent arcuate clutch segments 170, each having conically contoured axially opposite end surfaces 172 profiled to cooperatively slideably interengage with conical surfaces 108 and 156 on clutch actuating members 88 and 136, respectively. The clutch segments are disposed within a biasing spring 174 which is a flat strip of spring metal in the form of an equilateral triangle with the axial and circumferential center of each clutch segment fastened to the center of one leg of the triangle by a suitable fastening element 176. Such a clutch or collet arrangement is well known as is the fact that spring 174 supports the clutch segments and biases the latter radially outwardly to an expanded position while providing for the segments to be radially displaced to a contracted position against the spring bias.

As will be appreciated from the forgoing description, tubular shaft member 52, first and second clutch actuating members 88 and 136 and clutch unit 138 provide a tubular shaft assembly extending through the housing members coaxial with axis A between the front and rear ends of the apparatus. In connection with the use and operation of the apparatus for performing a drain cleaning operation, a drain cleaning snake S of given diameter is fed through the tubular shaft assembly and, with the component parts in the positions shown in FIGS. 3 and 5, the snake is freely slidable through the shaft assembly. The leading end of the snake is manually pushed into a drain or sewer line by the operator until an obstruction or obstacle is encountered, such as a blockage or bend in the drain or sewer line which precludes further manual advancement of the snake by the operator.

Motor 110 is then turned on by manipulating switch actuating knob 119 whereupon the shaft assembly rotates relative to snake S. Steel sleeve 50 protects the front housing member 14 from the abrasive effect of the rotating snake. The operator then pivots operating lever 62 counterclockwise from the solid line position to the broken line position shown in FIG. 3, whereupon tubular shaft 52 is axially displaced to the right in FIG. 3 together with transmission pulley 86, first clutch actuating member 88 and transmission belt 132. Such displacement is relative to second clutch actuating member 136 and to clutch unit 138 which is axially captured therebetween, whereby the clutch segments of clutch unit 138 are radially contracted relative to and into engagement with snake S to rotate the latter. Upon releasing operating lever 62, the biasing force of clutch spring 174 together with the biasing force of spring 78 attached between housing 14 and shaft 52 bias the latter and first clutch actuating member 88 to the left in FIG. 3 from the broken line positions thereof back to the solid line positions, whereupon the clutch segments of clutch unit 138 are biased by spring 174 to their expanded positions in which the snake is disengaged and the shaft assembly rotates relative thereto. During such axial displacement of shaft 52 to the left in FIG. 3, operating lever 62 is pivoted clockwise from the broken line position thereof back to the solid position through the toothed interengagement between the shaft and lever. The operator then further manually advances the snake relative to the apparatus and into the drain line until another obstruction is encountered whereupon the snake is rotated in response to pivoting operating lever 62 as described. When the drain cleaning operation has been completed and drive motor 110 turned off, operating lever 62 is displaced from the solid line to the broken line position thereof shown in FIG. 3, and lock pin 85 is inserted through openings 80 and 84 respectively in the lever and housing projection 82, whereby the lever is releasably held in a storage position. The apparatus can then be transported using either lever 62 or arm 40 of shroud 18 as a carrying handle.

Importantly in accordance with the invention, should the operator need or desire to use a drain cleaning snake having a diameter which is not accommodated by the clutch unit 138 installed in the apparatus, the latter can readily be replaced with an appropriate clutch unit simply by removing fasteners 44 and pivoting shroud 18 axially outwardly about frame member 30 to separate clutch actuating member 136 from clutch actuating member 88 which frees the clutch unit for removal. Upon replacement of the clutch unit, shroud 18 is pivoted back to facial engagement with housing member 16, and the insertion of fasteners 44 completes the replacement operation. Moreover, as will be appreciated from FIG. 5, the adjustment capability with respect to second clutch actuating member 136 enables adjustment of the clutch unit in the apparatus to accommodate different diameter snakes. Of further importance is the fact that when shroud 18 is released as described above, it can be lifted and removed from frame member 30 and bearing unit 150 and second clutch actuating member 136 are readily accessible for inspection and/or maintenance and are readily removable from the shroud and supporting sleeve 140 by the slip fit interengagement between the bearing unit, sleeve portion 146 and end portion of 152 of second clutch actuating member 136. Likewise, when shroud 18 is removed in the forgoing manner, access to the first clutch actuating member 88 and the component parts of the transmission is readily obtained by removing fasteners 22 holding housing member 16 in place relatively to housing members 12 and 14. Again, the slip fit interengagement between bearing unit 90 and end portion 56 of shaft 52 provides for readily removing transmission pulley 86 and first clutch actuating member 88 from shaft 52 for maintenance and/or replacement, and motor driven transmission pulley 126 is likewise uncovered and accessible for removal if necessary from motor shaft 124. Accordingly, it will be appreciated that the component parts of the apparatus which most frequently require inspection, maintenance and/or replacement are disposed adjacent one end of the apparatus to optimize serviceability, and the clutch unit which is an interchangeable component and which is generally subject to the most severe wear and thus the most frequent replacement is readily accessible at the one end of the apparatus without having to totally remove any of the housing components.

Of still further importance is the fact the major component parts of the apparatus are supported in suspension relative to the frame assembly by which the apparatus is supported on an underlying surface such as a floor. In this respect, tubular shaft 52, operating lever 62, motor 110, transmission pulleys 86 and 126 and first clutch actuating member 88 are all supported in and by upper front housing member 14 which is in turn supported between upper side legs **26*b* and 28*b* of frame assembly 24. Further, arm 40 of shroud 18 is pivotally supported on cross member 30 of the frame, and the shroud is releasably fastened to inserts 36 in the rear ends of upper frame legs 26*b* and 28*b*. Neither lower front housing member 12 nor transmission enclosing housing member 16** provide any support function with respect to the major component parts of the apparatus, and this advantageously enables the latter housing members to be made of plastic material, thus considerably reducing the weight of the apparatus relative to that which would exist if it were necessary to make these housing members from metal such as in prior art apparatus wherein the housing supports the apparatus relative to an underlying surface.

While considerable emphasis has been placed herein on the structures and structural interrelationships between the component parts of the apparatus in the preferred embodiment herein illustrated and described, it will be appreciated that other embodiments can be devised and that many changes can be made in the preferred embodiment without departing from the principles of the invention. In particular in this respect, it will be appreciated that clutch structures other than that of clutch unit 138 can be employed, and that arrangements other than the specific pivotal lever arrangement shown can be provided for achieving axial displacement of the clutch actuating components in connection with constricting the clutch to engage and rotate the snake. Furthermore, while it is preferred to provide for the drive belt to axially slide relative to the motor driven transmission pulley, the belt could axially slide relative to transmission pulley 86, or a belt drive arrangement could be provided in which the belt would be axially fixed relative to transmission pulley 126 while moving axially with transmission pulley 86. These and other modifications of the preferred embodiment as well as other embodiments of the invention will be obvious and suggested to those skilled in the art, whereby it is to be distinctly understood that the foregoing descriptive matter is to be interrupted merely as illustrative of the invention and not as a limitation.

We claim:

1. A drain cleaning apparatus for rotating a drain cleaning snake comprising, a first tubular shaft having a shaft axis, a second tubular shaft coaxial with and axially spaced from said first tubular shaft, a radially expandable and contractible clutch between and coaxial with said first and second tubular shafts, means supporting said first tubular shaft for rotation about said axis and for axial displacement toward and away from said second tubular shaft, means supporting said second tubular shaft for rotation about said axis, said first and second tubular shafts including means for radially contracting said clutch in response to axial displacement of said first tubular shaft toward said second tubular shaft for said clutch to engage and rotate a drain cleaning snake extending therethrough, and means for rotating and axially displacing said first tubular shaft including a drive motor and a drive coupling between said motor and said first tubular shaft.

2. The drain cleaning apparatus according to claim 1, wherein said drive coupling includes an endless belt driven by said motor.

3. The drain cleaning apparatus according to claim 2, wherein said belt is axially displaceable relative to said axis.

4. The drain cleaning apparatus according to claim 2, wherein said belt is axially displaceable with said first tubular shaft.

5. The drain cleaning apparatus according to claim 2, wherein said first tubular shaft includes a first pulley coaxial therewith and said drive motor includes a second pulley having a pulley axis parallel to said axis of said first tubular shaft, said belt being trained about said first and second pulleys.

6. The drain cleaning apparatus according to claim 5, wherein said belt is axially slidably displaceable relative to one of said first and second pulleys.

7. The drain cleaning apparatus according to claim 6, wherein said one of said pulleys is said second pulley.

8. The drain cleaning apparatus according to claim 5, wherein said apparatus includes a housing having a removable end housing member, said second tubular shaft being mounted in said housing member for removal therewith.

9. The drain cleaning apparatus according to claim 8, wherein said housing member is a first housing member and said housing includes a second removable housing member axially inwardly adjacent said first housing member, said first tubular shaft, said first and second pulleys and said belt being accessible when said second housing member is removed.

10. The drain cleaning apparatus according to claim 1, wherein said apparatus includes a housing having a removable end housing member, said second tubular shaft being mounted in said housing member for removal therewith.

11. The drain cleaning apparatus according to claim 10, wherein said housing includes another removable housing member inwardly adjacent said end housing member, said first tubular shaft and said drive coupling being accessible when said another housing member is removed.

12. The drain cleaning apparatus according to claim 1, wherein said drive coupling includes a first pulley on said first tubular shaft for rotation and axial displacement therewith, a second pulley driven by said motor about a pulley axis parallel to said shaft axis, and an endless belt trained about said first and second pulleys, said belt being axially slidably displaceable relative to one of said first and second pulleys.

13. The drain cleaning apparatus according to claim 12, wherein said means supporting said first tubular shaft means for rotation and axial displacement includes an axially reciprocable third tubular shaft coaxial with said first tubular shaft, said first tubular shaft being supported on said third tubular shaft for rotation relative thereto and axial displacement therewith, and means for axially reciprocating said third tubular shaft.

14. The drain cleaning apparatus according to claim 13, wherein said means for reciprocating said third tubular shaft includes a lever pivotal about a lever axis, and means interengaging said lever and said third tubular shaft for pivotal displacement of said lever in opposite directions about said lever axis to reciprocate said third tubular shaft in axially opposite directions.

15. The drain cleaning apparatus according to claim 14, wherein said means interengaging said lever and said third tubular shaft includes interengaging teeth on said lever and said third tubular shaft.

16. The drain cleaning apparatus according to claim 13, wherein said belt is axially slidably displaceable relative to said second pulley.

17. The drain cleaning apparatus according to claim 16, wherein said means for reciprocating said third tubular shaft includes a lever pivotal about a lever axis transverse to said axis of said first tubular shaft, and interengaging teeth between said lever and said third tubular shaft for pivotal displacement of said lever in opposite directions about said lever axis to reciprocate said third tubular shaft in axially opposite directions.

18. The drain cleaning apparatus according to claim 1, wherein said means supporting said second tubular shaft for rotation includes adjustable means for selectively adjusting the axial position of said second tubular shaft relative to said first tubular shaft.

19. The drain cleaning apparatus according to claim 18, wherein said means supporting said second tubular shaft includes an annular housing, said adjustable means including a sleeve in said housing coaxial with said axis of said first tubular shaft, and means interengaging said sleeve and said housing for adjusting the axial position of said sleeve relative to said housing.

20. The drain cleaning apparatus according to claim 19, and means for releasably holding said sleeve in an adjusted position relative to said housing.

21. The drain cleaning apparatus according to claim 19, wherein said means interengaging said sleeve and said housing includes threads therebetween.

22. The drain cleaning apparatus according to claim 21, and means for releasably holding said sleeve in an adjusted position relative to said housing.

23. The drain cleaning apparatus according to claim 1, wherein said means supporting said second tubular shaft for rotation includes a housing, and means supporting said housing for pivotal displacement between first and second positions about a pivot axis transverse to and spaced from said shaft axis.

24. The drain cleaning apparatus according to claim 23, wherein said second tubular shaft in said first position of said housing is coaxial with said shaft axis, and means for releasably holding said housing in said first position.

25. The drain cleaning apparatus according to claim 24, further including a frame having upper and lower frame portions, said means supporting said housing for pivotal displacement including means pivotally interengaging said housing means and said lower frame portion, and said means for releasably holding said housing in said first position including means interengaging said housing means and said upper frame portion.

26. The drain cleaning apparatus according to claim 25, wherein said lower frame portion includes a frame member transverse to said shaft axis, said means pivotally interengaging said housing and lower frame portion including an arm extending downwardly from said housing and having a lower end pivotally engaging with said frame member.

27. The drain cleaning apparatus according to claim 24, wherein said means supporting said second tubular shaft for rotation further includes a sleeve in said housing coaxial with said shaft axis in said first position of said housing, and means interengaging said sleeve and said housing for adjusting the axial position of said sleeve relative to said housing.

28. The drain cleaning apparatus according to claim 27, wherein said means interengaging said sleeve and said housing includes threads therebetween.

29. The drain cleaning apparatus according to claim 28, further including a frame having upper and lower frame portions, said means supporting said housing for pivotal displacement including means pivotally interengaging said housing and said lower frame portion, and said means for releasably holding said housing in said first position including means interengaging said housing and said upper frame portion.

30. The drain cleaning apparatus according to claim 29, wherein said lower frame portion includes a frame member transverse to said shaft axis, said means pivotally interengaging said housing and lower frame portion including an arm extending downwardly from said housing and having a lower end pivotally engaging with said frame member.

31. A drain cleaning apparatus for rotating a drain cleaning snake comprising, a housing having a housing axis and axially opposite ends, a tubular shaft coaxial with said axis and supported in said housing for axial reciprocation, a first annular clutch actuator mounted on said tubular shaft for rotation relative thereto about said housing axis and for axial displacement therewith, a second annular clutch actuator axially spaced from said first clutch actuator and supported in said housing for rotation relative thereto about said housing axis, a radially expandable and contractible annular clutch between said first and second clutch actuators and coaxial therewith, means for axially displacing said tubular shaft toward said second clutch actuator for said first and second clutch actuators to radially contract said clutch to engage a drain cleaning snake extending therethrough, a drive motor in said housing, and means including an endless belt directly coupling said motor and said first clutch actuator for rotating said first clutch actuator relative to said tubular shaft.

32. The drain cleaning apparatus according to claim 31, wherein said means coupling said motor and said first clutch actuator includes a first pulley rotatably driven by said motor and a second pulley for rotating said first clutch actuator, said belt being trained about said first and second pulleys.

33. The drain cleaning apparatus according to claim 32, wherein said belt is axially slidably interengaged with one of said first and second pulleys and axially fixed relative to the other.

34. The drain cleaning apparatus according to claim 33, wherein said one pulley is said first pulley.

35. The drain cleaning apparatus according to claim 34, wherein said first and second pulleys and said endless belt include interengaging teeth.

36. The drain cleaning apparatus according to claim 31, wherein said means for axially displacing said tubular shaft includes a lever mounted on said housing for pivotal displacement in opposite directions about a lever axis, and means interengaging said lever and said tubular shaft for pivotal displacement of said lever to axially displace said tubular shaft.

37. The drain cleaning apparatus according to claim 36, wherein said lever has a storage position adjacent said housing and generally parallel to said housing axis, and means for releasably interconnecting said lever and housing in said storage position of said lever.

38. The drain cleaning apparatus according to claim 36, wherein said means interengaging said lever and said tubular shaft includes interengaging teeth on said shaft and said lever.

39. The drain cleaning apparatus according to claim 31, wherein said clutch is axially captured between and supported by said first and second clutch actuators and comprises a plurality of circumferentially adjacent clutch members having radially expanded and contracted positions relative to said housing axis, and biasing means interconnecting and biasing said clutch members toward said expanded positions.

40. The drain cleaning apparatus according to claim 39, wherein said clutch members have axially opposite ends each converging with respect to said housing axis, and said first and second clutch actuators each have an end facing said clutch and diverging with respect to said housing axis.

41. The drain cleaning apparatus according to claim 40, wherein said biasing means includes a spring member extending about said plurality of clutch members intermediate said opposite ends thereof, and means for connecting said spring member to each of said plurality of clutch members.

42. The drain cleaning apparatus according to claim 31, wherein said housing includes first and second housing members, said tubular shaft, first clutch actuator, drive motor and belt being in said first housing member, said second clutch actuator being in said second housing member, said clutch being axially captured between and supported by said first and second clutch actuators, and means removably mounting said second housing member on said first housing member for enabling access to said clutch and said second clutch actuator.

43. The drain cleaning apparatus according to claim 42, wherein said apparatus further includes a frame having upper and lower frame portions, said frame supporting said first housing member in suspension, said lower frame portion including a frame member spaced from and extending transverse to said housing axis, and said means removably mounting said second housing member on said first housing member including means interengaging said second housing member and said frame member.

44. The drain cleaning apparatus according to claim 43, wherein said second housing member includes an annular shroud encircling said second clutch actuator and an arm extending downwardly from said shroud and having an end spaced therefrom, said means interengaging said second housing member and said frame member including means at said end of said arm engaging said frame member for pivotal displacement of said arm and shroud about a pivot axis transverse to said housing axis, and said means removably mounting said second housing member on said first housing member further including fastener means for releasably connecting said shroud to said upper frame portion.

45. The drain cleaning apparatus according to claim 44, and means in said shroud supporting said second clutch actuator for rotation about said housing axis and for axial adjustment relative to said shroud.

46. The drain cleaning apparatus according to claim 45, wherein said means in said shroud includes a sleeve rotatably supporting said second clutch actuator, and means interconnecting said sleeve and said shroud for relative axial displacement therebetween.

47. The drain cleaning apparatus according to claim 46, wherein said means interconnecting said sleeve and said shroud includes interengaging threads therebetween.

48. The drain cleaning apparatus according to claim 31, wherein said housing includes means supporting said second clutch actuator for axial adjustment toward and away from said first clutch actuator.

49. The drain cleaning apparatus according to claim 48, wherein said means supporting said second clutch includes a sleeve coaxial with said housing axis and rotatably supporting said second clutch actuator, and means interconnecting said sleeve and said housing for relative axial displacement therebetween.

50. The drain cleaning apparatus according to claim 49, wherein said means interconnecting said sleeve and said housing includes interengaging threads therebetween.

51. The drain cleaning apparatus for rotating a drain cleaning snake comprising, a housing having a housing axis and axially spaced front and rear ends, a tubular shaft coaxial with said axis and supported in said housing for axial reciprocation, a lever mounted on said housing for pivotal displacement in opposite directions about a lever axis, means interconnecting said lever and said tubular shaft for pivotal displacement of said lever to axially displace said tubular shaft, a first annular clutch actuating member including a first pulley mounted on said tubular shaft for rotation relative thereto about said housing axis and for axial displacement therewith, a second annular clutch actuating member axially spaced from said first clutch actuating member in the direction toward said rear end of said housing and supported in said housing for rotation relative thereto about said housing axis, a radially expandable and contractible annular clutch between said first and second clutch actuating members and coaxial therewith, said lever when pivoted in one of said opposite directions axially displacing said tubular shaft and said first clutch actuating member toward said second clutch actuating member for said first and second clutch actuating members to radially contract said clutch to engage a drain cleaning snake extending therethrough, a drive motor in said housing having a motor axis parallel to and spaced from said housing axis, a second pulley driven by said motor for rotation about said motor axis, and an endless belt trained about said first and second pulleys for rotating said first clutch actuating member relative to said tubular shaft, said belt being axially slidably interengaged with said second pulley.

52. The drain cleaning apparatus according to claim 51, wherein said lever has a storage position adjacent said housing and generally parallel to said housing axis, and means for releasably interconnecting said lever and housing in said storage position of said lever.

53. The drain cleaning apparatus according to claim 52, wherein said means interconnecting said lever and said tubular shaft includes interengaging teeth on said shaft and said lever.

54. The drain cleaning apparatus according to claim 51, wherein said rear end of said housing includes an opening coaxial with said housing axis, a sleeve in said opening and coaxial therewith, means including thread means interengaging said sleeve and housing for rotation of said sleeve in opposite directions relative to said housing axis to axially displace said sleeve in opposite directions relative to said housing, and means mounting said second clutch actuating member in said sleeve for rotation relative thereto and axial displacement therewith.

55. The drain cleaning apparatus according to claim 51, wherein said housing includes a first housing portion and a shroud portion having axially opposed inner ends intermediate said front and rear ends of said housing, said shroud portion having a shroud axis, means supporting said shroud portion for pivotal displacement relative to said first housing portion about a pivot axis spaced from and transverse to said housing axis and between a first position in which said shroud portion is coaxial with said housing axis and a second position in which said shroud portion is axially spaced from said first housing portion and said shroud axis is at an angle to said housing axis, means supporting said second clutch actuating member in said shroud portion for rotation relative thereto and pivotal displacement therewith, said clutch being axially captured between and supported by said first and second clutch actuating members in said first position of said shroud portion, and means for releasably connecting said shroud portion to said first housing portion in said first position of said shroud portion.

56. The drain cleaning apparatus according to claim 55, wherein said means supporting said second clutch actuating member in said shroud portion includes a sleeve in said shroud portion coaxial with said shroud axis, said sleeve and shroud portion being threadedly interengaged for rotation of said sleeve in opposite directions about said shroud axis to axially displace said sleeve in opposite directions relative to said shroud portion, and bearing means in said sleeve means supporting said second clutch actuating means for rotation relative thereto.

57. The drain cleaning apparatus according to claim 56, wherein said means interconnecting said lever and said tubular shaft includes interengaging teeth on said lever and said shaft, said lever having a storage position adjacent said first housing portion, and means for releasably holding said lever in said storage position.

58. In a drain cleaning apparatus for rotating a drain cleaning snake and comprising first and second annular clutch actuating members having a common axis and being axially spaced apart, a radially expandable and contractible annular clutch between and coaxial with said first and second clutch actuating members., means for axially displacing said first and second clutch actuating members relative to one another and to said clutch between first and second positions in which said clutch is respectively in an expanded position and a contracted position with respect to a drain cleaning snake extending therethrough, said clutch in said expanded and contracted positions respectively disengaging and engaging said snake, and means to rotate said first and second clutch actuating members and said clutch about said axis, the improvement comprising: means for incrementally adjusting the axial distance between said first and second clutch actuating members in said first position thereof.

59. The improvement according to claim 58, wherein one of said first and second clutch actuating members in said first position thereof is axially displaceable toward and away from the other of said first and second clutch actuating members in the first position thereof, and said means for adjusting the axial distance between said first and second clutch actuating members includes means for axially adjusting the first position of said other clutch actuating member relative to said one clutch actuating member.

60. The improvement according to claim 59, wherein said apparatus includes a housing, and support means supporting said other clutch actuating member on said housing in said first position thereof for rotation about said axis relative to said housing and for axial adjustment relative to said housing.

61. The improvement according to claim 60, wherein said support means includes a sleeve coaxial with said axis, and means interengaging said sleeve and said housing for axially adjusting the position of said sleeve relative to said housing, said other clutch actuating member being supported on said sleeve for rotation relative thereto and for axial displacement therewith.

62. In a drain cleaning apparatus for rotating a drain cleaning snake and comprising a housing having opposite ends, first and second annular clutch actuating members supported in said housing for rotation about a common axis between said ends, said first and second clutch actuating members being axially spaced apart, a radially expandable and contractible clutch between and coaxial with said first and second clutch actuating members, means for axially displacing said first and second clutch actuating members relative to one another and to said clutch between first and second positions in which said clutch is respectively in an expanded position and a contracted position with respect to a drain cleaning snake extending therethrough, said clutch in said expanded and contracted positions respectively disengaging and engaging said snake, and means for rotating said first and second clutch actuating members and said clutch about said axis, the improvement comprising: said housing including first and second housing portions having axially opposed inner ends between said opposite ends of said housing, means for removably mounting one of said first and second housing portions on the other, one of said first and second clutch actuating members being supported in said one housing portion for rotation relative thereto and for displacement therewith upon removal of said one housing portion from the other.

63. The improvement according to claim 62, wherein said clutch is axially captured between said first and second clutch actuating members in the mounted position of said one housing portion on the other and is released upon removal of said one housing portion.

64. The improvement according to claim 63, further including frame means for supporting said housing and including a frame member spaced from and transverse to said common axis, said one housing portion including an annular shroud coaxial with said common axis in said mounted position of said one housing portion, and said means mounting said one housing portion on the other including an arm fixed to said shroud and having an end spaced therefrom and pivotally interengaging with said frame member.

65. The improvement according to claim 62, further including a frame having upper and lower frame portions, said other housing portion being supported in suspension from said upper frame portion, and said other housing portion supporting the other of said first and second clutch actuating members, said means for displacing said first and second clutch actuating members and said means for rotating said first and second actuating members and said clutch.

66. The improvement according to claim 65, wherein said means for rotating said actuating members and said clutch includes a drive motor mounted in suspension in said other housing portion.

67. The improvement according to claim 65, wherein said frame includes a frame member spaced from and transverse to said common axis, said one housing portion including an annular shroud coaxial with said common axis in said mounted position of said one housing portion, and said means mounting said one housing portion on the other including an arm fixed to said shroud and having an end spaced therefrom and pivotally interengaging with said frame member.

* * * * *